United States Patent [19]

Hough et al.

[11] Patent Number: 4,649,320

[45] Date of Patent: Mar. 10, 1987

[54] THERMAL PROTECTOR FOR CIRCULAR FLUORESCENT LAMP ASSEMBLY

[75] Inventors: Harold L. Hough, Beverly; Robert P. Bonazoli, Hamilton, both of Mass.

[73] Assignee: GTE Products Corporation, Stamford, Conn.

[21] Appl. No.: 621,636

[22] Filed: Jun. 18, 1984

[51] Int. Cl.[4] ..... H05B 39/04

[52] U.S. Cl. ..... 315/100; 315/75; 315/119

[58] Field of Search ..... 315/100, 50, 74, 119; 316/105, 106

[56] References Cited

U.S. PATENT DOCUMENTS

| | | | |
|---|---|---|---|
| 3,161,746 | 12/1964 | Cook et al. | 315/100 X |
| 3,745,409 | 7/1973 | Netten | 315/100 |
| 3,846,674 | 11/1974 | McNulty | 361/106 X |
| 4,258,287 | 3/1981 | Hetzel | 315/58 |
| 4,388,677 | 6/1983 | Druffel | 361/105 X |
| 4,405,877 | 9/1983 | Haraden et al. | 313/318 |
| 4,536,817 | 8/1985 | Pejouhy | 361/105 |

FOREIGN PATENT DOCUMENTS

| | | | |
|---|---|---|---|
| 2516638 | 10/1976 | Fed. Rep. of Germany | 315/100 |
| 1500569 | 2/1978 | United Kingdom | 315/100 |

*Primary Examiner*—David K. Moore

*Attorney, Agent, or Firm*—José W. Jimenez

[57] ABSTRACT

A circular fluorescent lamp assembly having the entire ballasting circuit, along with a thermal protector, contained within the assembly's lamp holder. The thermal protector serves the dual function of preventing permanent damage to the assembly's ballast means and for extending lamp starting switch means operating life under normal end of lamp life cycling conditions. The thermal protector is responsive to the coil temperature of the ballast means and is electrically coupled in series with the ballast means, starting switch, capacitor and the lamp. One example of the thermal protector is a bimetal bottle switch.

25 Claims, 2 Drawing Figures

THERMAL PROTECTOR FOR CIRCULAR FLUORESCENT LAMP ASSEMBLY

TECHNICAL FIELD

The present invention relates to circular fluorescent lamp assemblies for use in incandescent sockets. More particularly, the present invention relates to a lamp assembly having the ballast circuit along with a thermal protector, contained within the lamp holder.

BACKGROUND

Various types of replaceable circular fluorescent lamp units have been devised for use in incandescent sockets. In preheat operating circuits used in units of this type, when the glow bottle switch is closed the circuit is completed and the heating current flows through the cathode at each end of the lamp. After a short preheat time (usually about one second), the switch is opened. This impresses a high voltage pulse across the lamp and causes an arc to strike between the cathodes. Preheat lamps of the type discussed here usually are operated on a single lamp ballast and have a simple choke coil or a choke with an auto-transformer to supply the voltage required to start and operate the lamp.

When the fluorescent lamp in such a unit reaches the end of its life, repeated attempts to start it will fail. With either a thermal-switch starter or a glow switch starter, the cathodes will continue to flash on and off until the starter fails or the lamp is replaced. Furthermore, the ballast may be permanently damaged by overheating. To alleviate the problem of ballast overheating, one known type of this lamp unit has had a thermal breaker, or a one-shot thermal fuse, coupled to the ballast contained within the central housing of the lamp holder. Such a lamp holder normally works in conjunction with a package having a glow bottle switch and a capacitor integral with a replaceable circular lamp. One disadvantage of this type of lamp assembly, however, is the additional cost of replacing the circular lamp package containing the glow bottle and capacitor when the lamp has reached its end of life. This is necessary even though the glow bottle switch and capacitor may still be operative. Also, in the case where a thermal fuse is used, the entire lamp holding unit is rendered inoperable until such a fuse is replaced.

In many fluorescent lamp assemblies, the function of preventing ballast overheating has previously been performed by cut out protector (COP) starters of the manual reset or automatic reset types. This type of starter is housed in its own enclosure and is designed to be a user replaceable element in the operating circuit. The disadvantages of using these types of starters in many present circular fluorescent lamp assemblies include relatively high cost and, in the case of a normal reset type, the nuisance factor of accessibility to reactivate. In the case of the automatic reset type, disadvantages include the drawing of one watt of unused power for the heater contained within and the lack of protection against fixture misapplication or ballast failure while the lamp is in operation.

It is believed, therefore, that a lamp assembly which overcomes the several disadvantages associated with the prior art devices mentioned above would constitute a significant advancement in the art.

DISCLOSURE OF THE INVENTION

It is, therefore, a primary object of this invention to overcome the disadvantages of the prior art devices such as mentioned above.

It is another object of the invention to provide a lamp holder having therein means for preventing ballast overheating while extending the operating life of lamp starting switch.

In accordance with one aspect of the present invention, there is provided an electric circuit for use with an electric lamp having a pair of cathodes. The electric circuit includes lamp starting switch means and capacitance means coupled in parallel with the lamp starting switch means, the lamp starting switch means and capacitance means adapted for being coupled in a shunt fashion with the electric lamp. The electric circuit further includes ballast means adapted for being coupled in series with the electric lamp. The electric circuit also includes means for preventing ballast overheating and extending lamp starting life means for preventing ballast overheating while extending the operating life of the lamp starting switch. The means for preventing ballast overheating and extending starting switch life is electrically coupled in series with the ballast means, lamp starting switch means, capacitance means and the electric lamp.

In accordance with another aspect of the present invention, there is provided a lamp assembly which includes an electric lamp having a pair of cathodes and a lamp holder for supporting the lamp in a detachable manner. The lamp holder has a longitudinally extending central body with a plurality of radial arms attached thereto and transversely projecting therefrom, the arms terminating in lamp holding means. The central body has a lower portion that includes an electrically conductive base. The lamp assembly further includes an electric circuit located within the holder and designed for use with the lamp. The electric circuit includes lamp starting switch means and capacitance means coupled in parallel with the lamp starting switch means. The lamp starting switch means and capacitance means are coupled in a shunt fashion with the cathodes of the lamp. The electric circuit further includes means for preventing ballast overheating while extending the operating life of the lamp starting switch. The means for preventing ballast overheating and extending starting switch life is electrically coupled in series with the ballast, lamp starting switch, capacitance means and the lamp.

In accordance with still another aspect of the present invention, there is provided a lamp holder for an electric lamp. The lamp holder includes a central body having a longitudinal axis and a pair of diametrically opposed arms projecting from the body and terminating in lamp holding means. The central body has a lower portion that includes an electrically conductive base. The lamp holder further includes lamp starting switch means and capacitance means located within one of the arms. The capacitance means is coupled in parallel with the lamp starting switch means. The lamp socket receiving means is designed for electrically coupling the lamp with the lamp holder and is substantially located within the other of the arms and is located adjacent the lamp holding means. The lamp holder also includes means for connecting the parallel coupling to the lamp socket receiving means, the connecting means extending from one of said arms to the other. The lamp holder further includes ballast means located within the central body and having a lead wire extending down to and connected with the base. The central body further includes means for preventing ballast overheating and extending lamp starting switch life. The means for preventing ballast overheating and extending starting switch life is electrically coupled in series with and located adjacent the ballast means and includes a lead wire extending over to the lamp socket receiving means. Finally, a lead wire extends from the lamp socket receiving means to the base and is electrically connected thereto.

BEST MODE FOR CARRYING OUT THE INVENTION

For a better understanding of the present invention together with other and further objects, advantages and capabilities thereof, reference is made to the following disclosure and appended claims in conjunction with the above described drawings.

Figure 1:
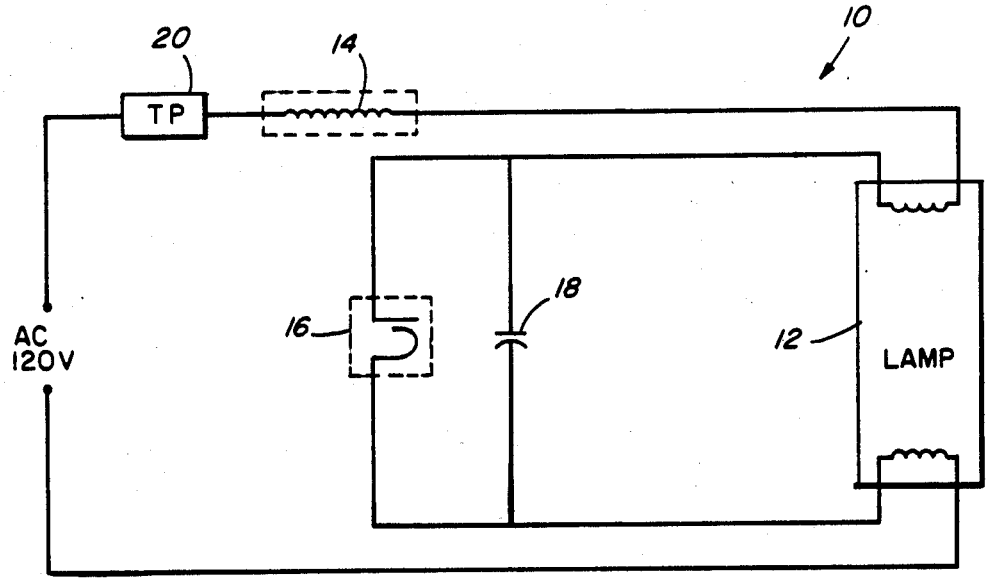
FIG. 1 illustrates a schematic circuit diagram of the lamp operating circuit of the invention utilizing a thermal protector.

With reference now to the drawings, there is shown in FIG. 1 an electric circuit 10 of a lamp operating circuit utilizing a thermal protector 20 in accordance with the teachings of the instant invention. Circuit 10 further includes a fluorescent lamp 12, ballast means 14 and lamp starting switch means 16 coupled in parallel with capacitance means 18. The lamp starting switch means 16 and capacitance means 18 are coupled in a shunt fashion across the cathodes of lamp 12. Thermal protector 20 is coupled in series with ballast means 14, lamp 12 and circuit elements 16 and 18. In circuit 10, lamp starting switch means 16 comprises a glow bottle starter switch, capacitance means 18 comprises a capacitor and ballast means 14 comprises a transformer.

The principle function of glow bottle starting switch 16 is to close the starting circuit of lamp 12 while the cathodes heat up, and then to open the circuit to start the lamp. If the arc fails to strike, the starting switch 16 continues to repeat the starting cycle until the lamp starts. Once the lamp has started, the voltage across lamp 12 and the glow switch 16 drops to a point where it is not sufficient to cause glow switch 16 to glow. Thus, glow switch starter 16 consumes substantially no power when lamp 12 is operating and is available for immediate restarting when the lamp is turned off. The glow switch starter 16 will continue to repeat the starting cycle even when lamp 12 has reached the end of life conditions. Constant repetition of this starting cycle will lead to both a decrease in the operating life of glow bottle switch 16 and the overheating of transformer 14, which can readily lead to permanent damage of the transformer coil or winding.

In accordance with the teachings of this invention, there is provided a thermal protector 20 that performs the dual function of preventing ballast 14 overheating and extending the operating life of the glow bottle starter switch 16 when lamp 12 has reached the end of its life. Thermal protector 20 is designed to be a recycling type of thermal breaker that is responsive to the coil temperture of ballast transformer 14. Thermal protector 20 can be a bimetal bottle switch, a positive temperature coefficient (PTC) device or any other device that is sensitive to heat.

At the end of lamp life conditions, the preheat current will continuously cycle through transformer 14 in an attempt to start lamp 12. This continuous cycling of the preheat current will cause the ballast insulation system to fail due to the ballast overheating from high $I^2R$ losses. Also, the glow bottle switch 16 will cycle several times in a relatively short period, thereby decreasing the operating life thereof. Thermal protector 20 is designed to sense the high coil temperature of transformer 14, upon overheating, and create an open circuit situation to disengage the starting circuit until transformer 14 cools down sufficiently for thermal protector 20 to close again. The thermal protector trip temperature is determined by the lamp holder material (plastic, metal, etc.) and the class of the ballast insulation system.

Figure 2:
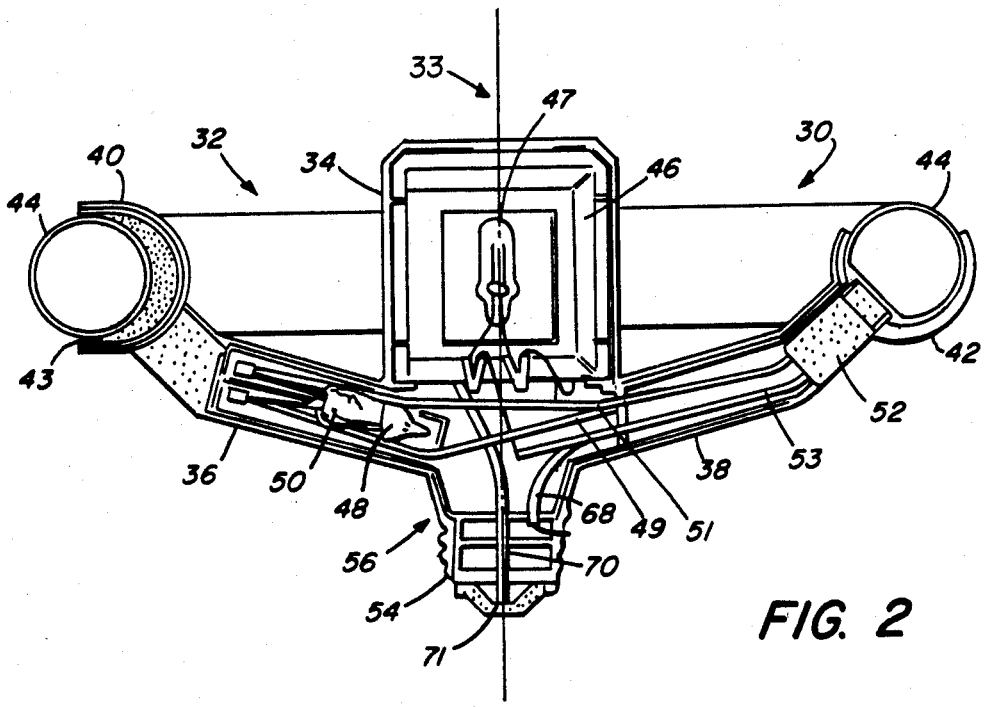
FIG. 2 is a sectional view of the lamp assembly of the invention including as part thereof a thermal protector in accordance with one embodiment of the invention.

Referring now to FIG. 2, there is shown a sectional view of the lamp assembly of the invention. Lamp assembly 30 comprises a lamp holder 32 having a longitudinally extending central body 34 with a longitudinal axis 33. Radial arms 36 and 38 are attached to body 34 and project transversely therefrom. The terminal ends or lamp receiving means 40 and 42, respectively, of arms 36 and 38 are formed to receive and hold a circular lamp 44, which is preferably of the fluorescent variety. An electrically conductive base 54 is fixed to a lower portion 56 of central body 34.

The central body 34 can be hollow and contain therewithin ballast means 14 for lamp 44. Ballast means 14 can be either a transformer or, alternatively, a choke coil. FIG. 2 illustrates a transformer 46 located within central body 34 and having a base connecting wire 70 extending down to and electrically coupled with the lamp base 54. A glow bottle starter switch 48 and a capacitor 50 are located within radial arm 36 and have lead wires 49 and 51 coupling the same to lamp socket receiving means (or plug) 52. Socket means 52 electrically couples lamp holder 32 to circular lamp 44, completing the circuit so that glow starter switch 48 and capacitor 50 are coupled in a shunt fashion with the cathodes of lamp 44.

FIG. 2 further illustrates the lamp base 54 that is screwed onto the lower portion 56 of lamp holder 32. Base connecting wire 68, which completes the lamp operating circuit within lamp holder 32, extends from socket means 52 to lamp base 54 and is connected electrically thereto. Base connecting wire 70 projects through the bottom of base 54 and is soldered to insulated central conductor 71 thereof.

In FIG. 2, the thermal protector is illustrated as a recycling type of bimetal bottle switch 47 which is located adjacent and is electrically coupled with transformer 46. In order to maintain switch 47 positioned adjacent transformer 46, an adhesive strip should be placed over switch 47 and secured around transformer 46. Bimetal bottle switch 47 also has a lead wire 53 extending over to four terminal plug 52. The bimetal bottle switch 47 is designed to be closed when the coil temperature of transformer 46 is within the range of about 95° Celsius to about 110° Celsius and to open when the coil temperture of transformer 46 exceeds a temperture of about 110° Celsius. Switch 47 will stay open and disengage the starting circuit until transformer 46 cools down sufficiently for switch 47 to close again.

Toward the end of the life of lamp 44, glow bottle switch 48 will cycle in an attempt to re-start but lamp 44 will not do so due to the cathode emitting material depletion. As a result, preheat current continuously cycles through transformer 46. In the case of an eight-inch diameter circular lamp, these currents are typically 700 to 800 milliamperes (ma) which are two and one-half times the normal operating current (about 300 ma). Without protection of the kind provided by the present invention, this continuous cycling of the preheat current will cause the ballast insulation system to fail due to ballast overheating. Also, under these conditions the glow bottle switch 48 will cycle several times in a relatively short period, thereby decreasing the operating life thereof. Testing has shown that toward end of lamp life, addition of a thermal protector in accordance with the teachings of this invention, will serve to extend the life of the choke (i.e., ballast) substantially (several thousands of hours) while the useful life of the glow bottle switch can be approximately doubled (in comparison with the same circuit without a thermal protector).

The use of a thermal protector in lamp assembly 30 also aids in reducing the annoyance factor by one-half of an energized but blinking (i.e., nonstarting) lamp. The thermal protector also provides a means for circuit interruption to thereby enable cool down in the event of unit misapplication (hot ambient), premature glow bottle switch or capacitor failure (due to shorting), or ballast failure.

Thus, there has been shown and described an improved circular fluorescent lamp assembly having a thermal protector that performs the dual function of preventing the overheating of the ballast and extending the operating life of the glow bottle starter switch when the fluorescent lamp has reached the end of its life. In addition, since the thermal protector and the entire ballasting circuit is contained within the assembly's lamp holder, only the lamp itself need to replaced upon lamp failure. This cuts down on the additional cost of replacing a circular lamp package containing an operative glow bottle and capacitor when the lamp has reached the end of its life. Finally, the use of the thermal protector will serve to both double the useful life of the glow bottle switch and extend the life of the ballast indefinitely.

While there have been shown and described what are at present considered the preferred embodiments of the invention, it will be obvious to those skilled in the art that various changes and modifications may be made therein without departing from the scope of the invention as defined by the appended claims.

What is claimed is:

1. An electric circuit for use with an electric lamp having a pair of cathodes, said electric circuit comprising:

lamp starting switch means;

capacitance means coupled in parallel with said lamp starting switch means, said lamp starting switch means and said capacitance means adapted for being coupled in a shunt fashion with said cathodes of said electric lamp;

ballast means adapted for being coupled in series with said electric lamp; and means for preventing ballast means overheating and for extending the operating life of said lamp starting switch means electrically coupled in series with said ballast means, starting switch means, capacitance means and electric lamp.

2. The electric circuit according to claim 1 wherein said means for preventing ballast means overheating and extending starting switch means life includes a recycling type thermal breaker, said breaker being responsive to the coil temperature of said ballast means.

3. The electric circuit according to claim 2 wherein said thermal breaker is a bimetal bottle switch.

4. The electric circuit according to claim 3 wherein said bimetal bottle switch is closed when said coil temperature is in the range of about 95° Celsius to about 110° Celsius and opened when said coil temperature exceeds 110° Celsius.

5. The electric circuit according to claim 2 wherein said thermal breaker is a positive temperature coefficient device.

6. The electric circuit according to claim 1 wherein said ballast means includes a transformer.

7. The electric circuit according to claim 6 wherein said lamp starting switch means includes a glow bottle starter switch.

8. The electric circuit according to claim 7 wherein said capacitance means includes a capacitor.

9. A lamp assembly comprising:

an electric lamp having a pair of cathodes;

a lamp holder supporting said lamp in a detachable manner, said lamp holder having a longitudinally extending central body with a plurality of radial arms attached thereto and transversely projecting therefrom, said arms terminating in lamp holding means, said central body having a lower portion including an electrically conductive base; and an electric circuit for use with said lamp and located within said lamp holder, said electric circuit including lamp starting switch means, capacitance means coupled in parallel with said lamp starting switch means, said lamp starting switch means and said capacitance means coupled in a shunt fashion with said cathodes of said lamp, and means for preventing ballast means overheating and extending the operating life of said lamp starting switch means, said means for preventing ballast means overheating and extending starting switch means life electrically coupled in series with said ballast means, starting switch means, capacitance means and lamp.

10. The lamp assembly according to claim 9 wherein said means for preventing ballast means overheating and extending starting switch means life includes a recycling type thermal breaker, said breaker being responsive to the coil temperature of said ballast means.

11. The lamp assembly according to claim 10 wherein said thermal breaker is a bimetal bottle switch.

12. The lamp assembly according to claim 11 wherein said bimetal switch is closed when said coil temperature is in the range of about 95° Celsius to 110° Celsius and is opened when said coil temperature exceeds 110° Celsius.

13. The lamp assembly according to claim 10 wherein said thermal breaker is a positive temperature coefficient device.

14. The lamp assembly according to claim 9 wherein said ballast means includes a transformer.

15. The lamp assembly according to claim 14 wherein said lamp starting switch means includes a glow bottle starter switch.

16. The lamp assembly according to claim 15 wherein said capacitance means includes a capacitor.

17. A holder for an electric lamp, said lamp holder comprising:

a central body having a longitudinal axis;

a pair of diametrically opposed arms projecting from said body and terminating in lamp holding means, said central body having a lower portion including an electrically conductive base;

lamp starting switch means and capacitance means located within one of said arms, said capacitance means coupled in parallel with said lamp starting switch means;

lamp socket receiving means for electrically coupling said lamp with said holder located substantially within the other of said arms adjacent said lamp holding means;

means for connecting said parallel coupling to said lamp socket receiving means, said connecting means extending from one of said arms to the other of said arms;

ballast means located within said central body, said ballast means having a lead wire extending down to and electrically coupled with said base;

means for preventing ballast means overheating and extending lamp starting switch means operating life, said means for preventing ballast means overheating and extending starting switch means life electrically coupled in series with and located adjacent said ballast means and including a lead wire extending over to said lamp socket receiving means; and a lead wire extending from said lamp socket receiving means to said base for completing the lamp operating circuit within said lamp holder.

18. The lamp holder according to claim 17 wherein said means for preventing ballast means overheating and extending starting switch means life includes a recycling type thermal breaker, said thermal breaker located within said central body and being responsive to the coil temperature of said ballast means.

19. The lamp holder according to claim 18 wherein said thermal breaker is a bimetal bottle switch.

20. The lamp holder according to claim 19 wherein said bimetal switch is closed when said coil temperature is within the range of about 95° Celsius to 110° Celsius and is opened when said coil temperature exceeds 110° Celsius.

21. The lamp holder according to claim 18 wherein said thermal breaker is a positive temperature coefficient device.

22. The lamp holder according to claim 17 wherein said thermal breaker is held in place by an adhesive strip means.

23. The lamp holder according to claim 17 wherein said ballast means includes a transformer.

24. The lamp holder according to claim 23 wherein said lamp starting switch means includes a glow bottle starter switch.

25. The lamp holder according to claim 24 wherein said capacitance means includes a capacitor.

* * * * *